US007706563B2

(12) United States Patent
Stewart

(10) Patent No.: US 7,706,563 B2
(45) Date of Patent: Apr. 27, 2010

(54) CONCENTRIC RADIAL RING MOTOR

(75) Inventor: John S. Stewart, Bloomington, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 1163 days.

(21) Appl. No.: 11/311,418

(22) Filed: Dec. 19, 2005

(65) Prior Publication Data

US 2007/0140522 A1 Jun. 21, 2007

(51) Int. Cl.
*H04R 1/00* (2006.01)
*H04R 9/06* (2006.01)
*H04R 11/02* (2006.01)

(52) U.S. Cl. ..... 381/421; 381/396; 381/420; 381/422

(58) Field of Classification Search ..... 381/421
See application file for complete search history.

(56) References Cited

U.S. PATENT DOCUMENTS 4,608,463 A * 8/1986 Burgess et al. ..... 381/420
5,267,111 A 11/1993 Nishimura et al.
5,430,805 A 7/1995 Stevenson et al.
5,461,677 A * 10/1995 Raj et al. ..... 381/422
5,748,760 A 5/1998 Button
5,898,786 A 4/1999 Geisenberger
6,020,805 A 2/2000 Berja
6,095,280 A 8/2000 Proni
6,359,997 B2 3/2002 Geisenberger et al.
6,563,932 B2 5/2003 Cork
6,587,570 B1 7/2003 Pavlovic
6,611,606 B2 * 8/2003 Guenther ..... 381/421
6,639,994 B1 * 10/2003 Proni et al. ..... 381/406
7,058,195 B2 * 6/2006 Trandafir ..... 381/409

* cited by examiner

*Primary Examiner*—Curtis Kuntz
*Assistant Examiner*—Matthew Eason
(74) *Attorney, Agent, or Firm*—Brinks Hofer Gilson and Lione

(57) ABSTRACT

A voice-coil transducer includes two radially concentric magnets, a voice-coil located in the gap between the inner and outer magnets, and a diaphragm coupled to the voice-coil. An audio loudspeaker includes the voice-coil transducer with two radially concentric magnets, a voice-coil located within the gap between the inner and outer magnets, a diaphragm coupled to the voice-coil in order to create sounds from the voice-coil, and a chassis to support the magnets, voice-coil, and diaphragm.

31 Claims, 8 Drawing Sheets

CONCENTRIC RADIAL RING MOTOR

BACKGROUND OF THE INVENTION

1. Technical Field

This invention relates to audio transducers. More particularly, this invention relates to lightweight, audio transducers.

2. Related Art

Electrodynamic loudspeakers include a diaphragm connected to a voice-coil. The voice-coil is positioned in an air gap between the poles of a magnet. The magnets produce magnetic flux in the air gap. These magnets are typically permanent magnets and are used in a magnetic circuit of ferromagnetic material to direct the flux produced by the permanent magnet into the air gap.

The voice-coil is placed in the air gap with its conductors wound substantially cylindrically so as to be placed perpendicular to the main component of the magnetic flux in the air gap. The coil is then connected mechanically to a loudspeaker diaphragm that is driven or vibrated by the axial motion of the voice-coil produced by the motor force on the voice-coil when it is connected to an audio amplifier. The coil is referred to the "voice" coil because, in loudspeakers or similar electromechanical transducers, the frequency range of interest is in the extended range of the human voice.

The voice-coil is normally connected to an audio amplifier of some type that produces a current in the voice-coil that is a function of the electrical signal to be transformed by the loudspeaker into an audible, sub-audible or ultrasonic pressure variation. The voice-coil is intended to carry a current in a direction that is substantially perpendicular to the direction of the lines of magnetic flux produced by the permanent magnet. The magnetic structure is often arranged to provide cylindrical symmetry with an annular air gap in which the magnet flux lines are directed radially with respect to the axis of cylindrical symmetry of the loudspeaker.

Permanent-magnet electro-dynamic loudspeakers employ a diaphragm that is vibrated by an electromechanical drive. The drive generally includes a motor structure comprised of one or more magnets plus ferrous material, and a voice-coil with an electrical signal passed through the voice-coil. The interaction between the current passing through the voice-coil and the magnetic field produced by the permanent magnet causes the voice-coil to oscillate in accordance with the electrical signal and, in turn, drives the diaphragm and produces sound.

In loudspeaker magnet systems, ferrous pole material is employed to create the gap and to guide the magnetic field, i.e., create the magnetic circuit. An axially magnetized magnet is positioned in a ferrous cylinder so that one pole of the magnet is in contact with bottom of the cylinder. The diameter of the magnet is less than that of the cylinder such that there is created an annular gap between the lateral sides of the magnet and interior walls of the cylinder. A second ferrous material, such as a disk that is roughly the same diameter as the magnet, is placed on top of the magnet so as to be in contact with the opposing pole of the magnet. The cylinder focuses the magnetic flux from the magnetic pole with which it is in contact and disk. One or multiple axially magnetized magnets may be included in such systems.

These ferrous materials may contribute a significant portion of the total mass of the system. Ferrous systems also may increase voice-coil inductance. Thus, as frequency increases, voice-coil inductance increases, resulting in reduced speaker output. Further, in operation, the resistance of the conductive material of the voice-coil causes the production of heat in the voice-coil or winding. The presence of ferromagnetic material may also contribute to an increased production of heat.

The problems produced by heat generation are further compounded by temperature-induced resistance, commonly referred to as power compression. As the temperature of the voice-coil increases, the DC resistance of copper or aluminum conductors or wires used in the voice-coil also increases. For example, a copper wire voice-coil that has a resistance of six ohms at room temperature has a resistance of twelve ohms at 270 degree C. (520 degree F.) At higher temperatures, power input is converted mostly into additional heat rather than sound, thereby seriously reducing loudspeaker efficiency.

Thus, heat production is a major determinant of loudspeaker maximum sound pressure output. Thus, devices may be limited in their maximum sound pressure because of the heat they generate. In a typical single voice-coil design using a ceramic magnet, the loudspeaker is very large and a heat sink is usually not employed. As such, because the driver must not overheat, the maximum allowable temperature limits the input power capacity of the loudspeaker. A common approach in the design of high power professional loudspeakers consists of simply making the motor structure large enough to dissipate the heat generated in the voice-coil. Producing a high power loudspeaker in this way results in a very large and heavy loudspeaker with a large motor structure. These large and heavy loudspeakers may not be feasible for use in vehicular applications due to weight and space limitations.

Thus, there is a need for loudspeaker systems that dissipate the heat generated by the voice-coil, thus, improving efficiency and producing greater power output. It may also be desirable to have a magnetic field system that is constant in a region and drops to a low value outside the region. Therefore, a need exists for a magnetic field system that can produce a desired magnetic field distribution without the use of any ferrous pole material.

SUMMARY

This invention provides a voice-coil transducer, which may include two radially concentric and radially polarized magnets, one magnet contained within the other. A voice-coil may be located within the gap between the inner and outer annular-shaped magnets. The voice-coil may be coupled to a diaphragm for generating sound through a loudspeaker.

An audio loudspeaker, which may include two radially concentric and radially polarized magnets, one magnet contained within the other also is provided A voice-coil including a former and windings may be located within the gap between the inner and outer annular-shaped magnets. The voice-coil may be coupled to a diaphragm for generating sound through a loudspeaker. The magnets, voice-coil, and diaphragm may be supported by a chassis which may also serve as a heat sink for the magnets.

The application presents an audio loudspeaker, which may include two radially concentric and radially polarized magnets, one magnet contained within the other. Alternatively, a number of voice-coils composed of a former and windings may be located within the gaps formed by the annular-shaped magnets, such as within the inner diameter of the inner magnet, or outside of the outer diameter of the outer magnet. The voice-coils may be coupled to a diaphragm for generating sound through a loudspeaker. The magnets, voice-coils, and diaphragm may be supported by a chassis which also serves as a heat sink for the magnets.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
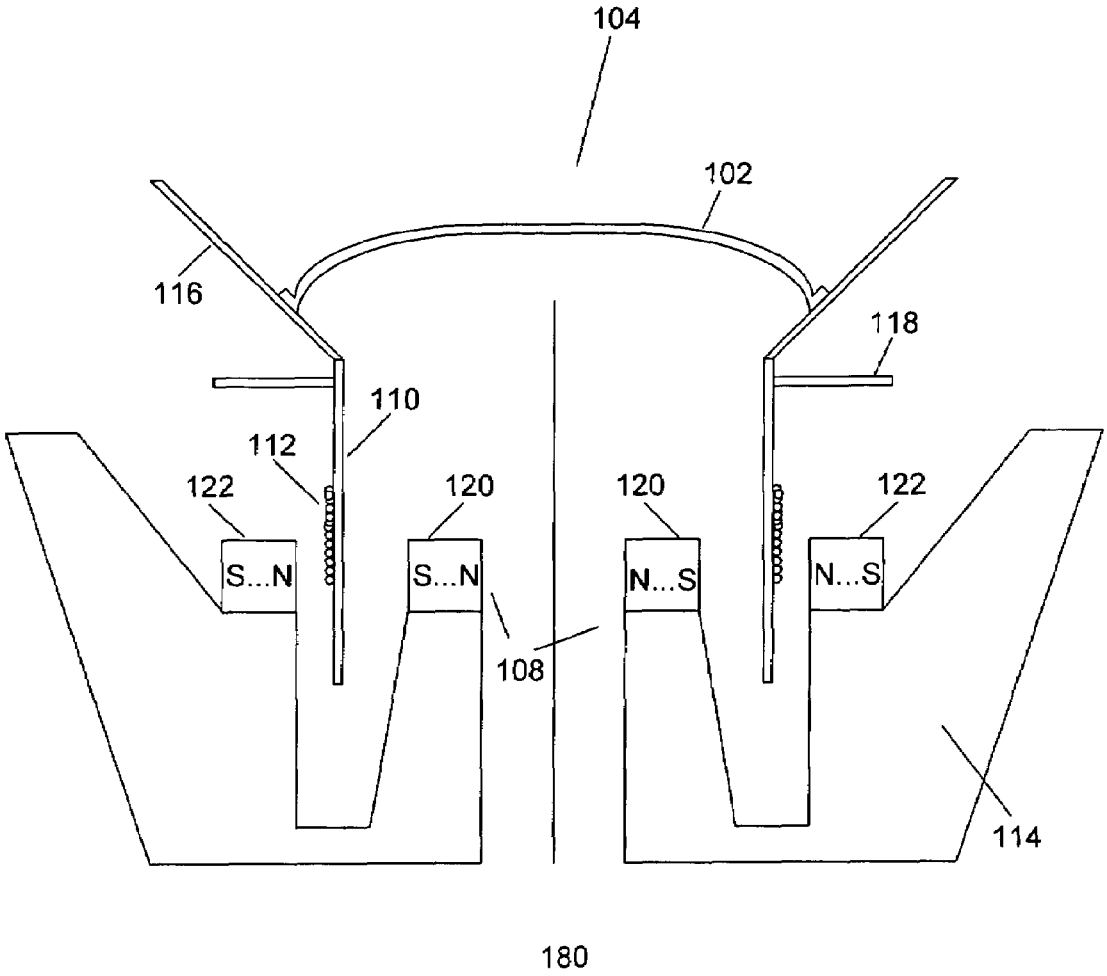
FIG. 1 is a cross-sectional view of a radial concentric magnet system for an audio loudspeaker.

FIG. 1 is a cross-sectional diagram of a loudspeaker. The loudspeaker 100 includes a loudspeaker diaphragm 102, a dome 104, a voice-coil 106, and magnet system 108. The voice-coil 106 includes former 110 and windings 112. The voice-coil windings 112 are wound cylindrically around former 110. The loudspeaker diaphragm 102 is held within a chassis 114 by a suspension system provided by surround 116 and spider 118. Magnet system 108 may include two generally circular or annular-shaped ring magnets arranged concentrically with regard to each other. The loudspeaker may be cylindrically symmetric about the axis of symmetry 180.

Figure 2:
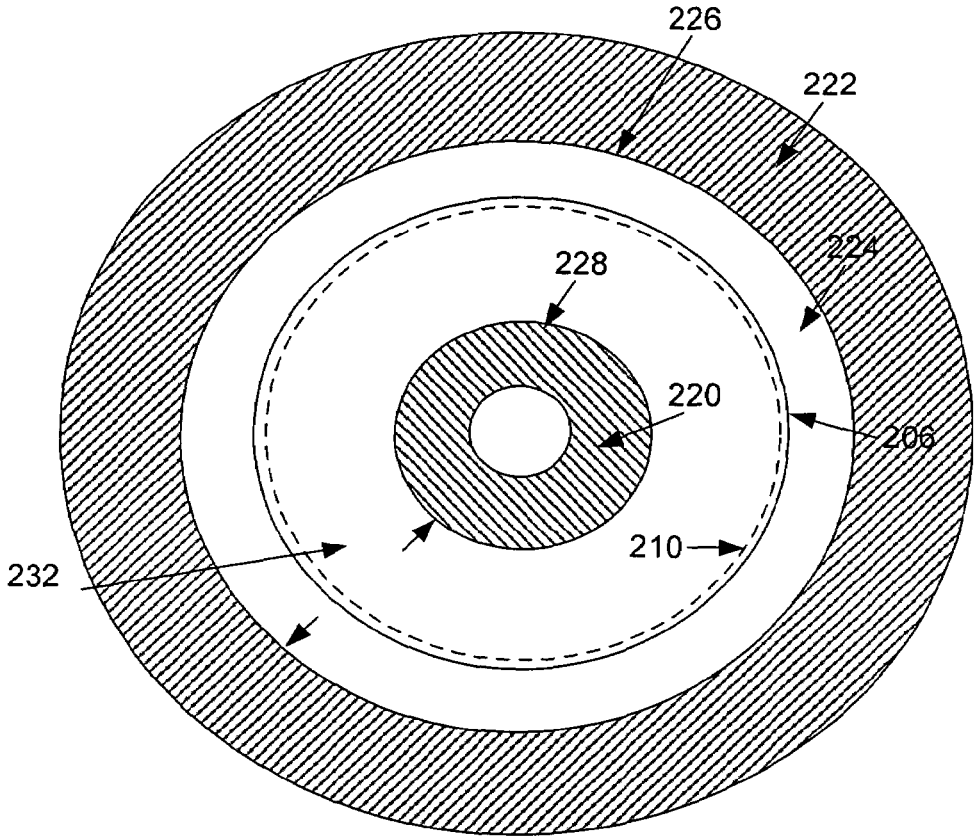
FIG. 2 is a top-down view of the radial concentric magnets including a voice-coil.

As shown in FIG. 2, inner magnet 220 may be positioned within the interior of the former 210 and outer magnet 222 may be positioned exterior of the former 210 to form two concentric rings. Outer magnet 222 may be configured and adapted to at least partially encircle voice-coil former 210, voice-coil 206, and inner magnet 220. Thus, outer magnet 222 may be a disk or annular-shaped ring having a central hole 224. Inner magnet 220 may be configured to fit within the central hole 224 of outer magnet 222 and also may be disk or ring shaped. For example, outer magnet 222 and inner magnet 220 may be positioned as two concentric rings as shown in FIG. 2. The concentric design of the inner and outer magnets (220 and 222) increases the strength of the magnetic field in the vicinity of the voice-coil 206 approximately by a factor of two over a single magnet design, which results in higher output by the loudspeaker.

The interior edge 226 of the central hole 224 of outer magnet 222 may be positioned in close, but non-contacting, proximity to the voice-coil 206 and voice-coil former 210. The outer edge 228 of inner magnet 220 may be positioned in close, but non-contacting, proximity to the interior surface 230 of former 210. In this way, voice-coil 206 and former 210 are positioned in a gap 232 between the interior edge 226 of the central hole 224 of outer magnet 222 and the outer edge 228 of inner magnet 220. The gap 232 may be from 1 mm to 10 mm in width. In one example, the gap may be from about 1.5 mm to about 5 mm in width. The outer diameter of the outer magnet 222 may be between about 25 cm and about 450 cm. In addition, the gap between inner magnet 220 and outer magnet 222 may be filled with a magnetic solution, such as a colloidal solution of oil and magnetic particles.

Figure 5:
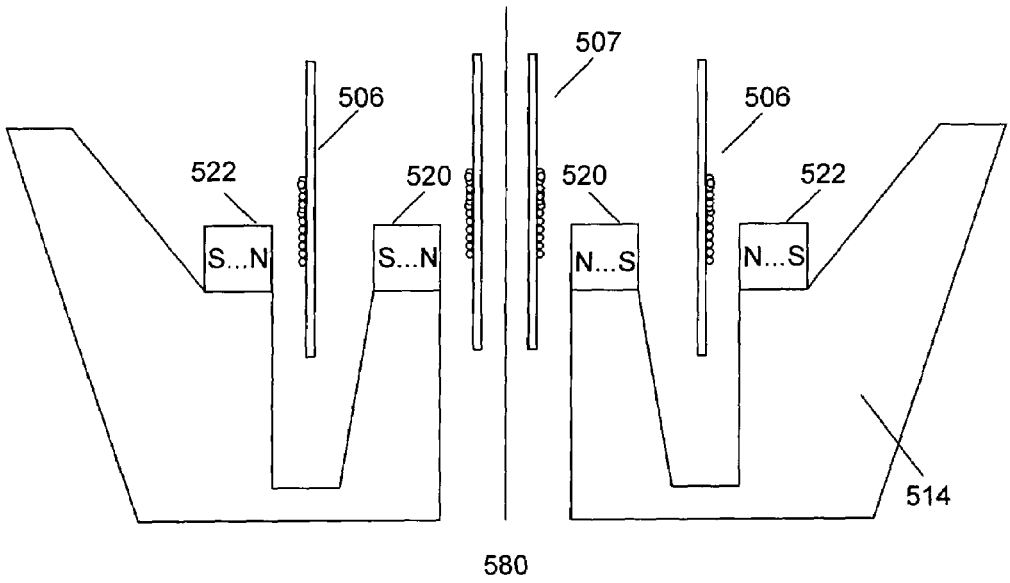
FIG. 5 is an audio loudspeaker with a double voice-coil design.
Figure 6:
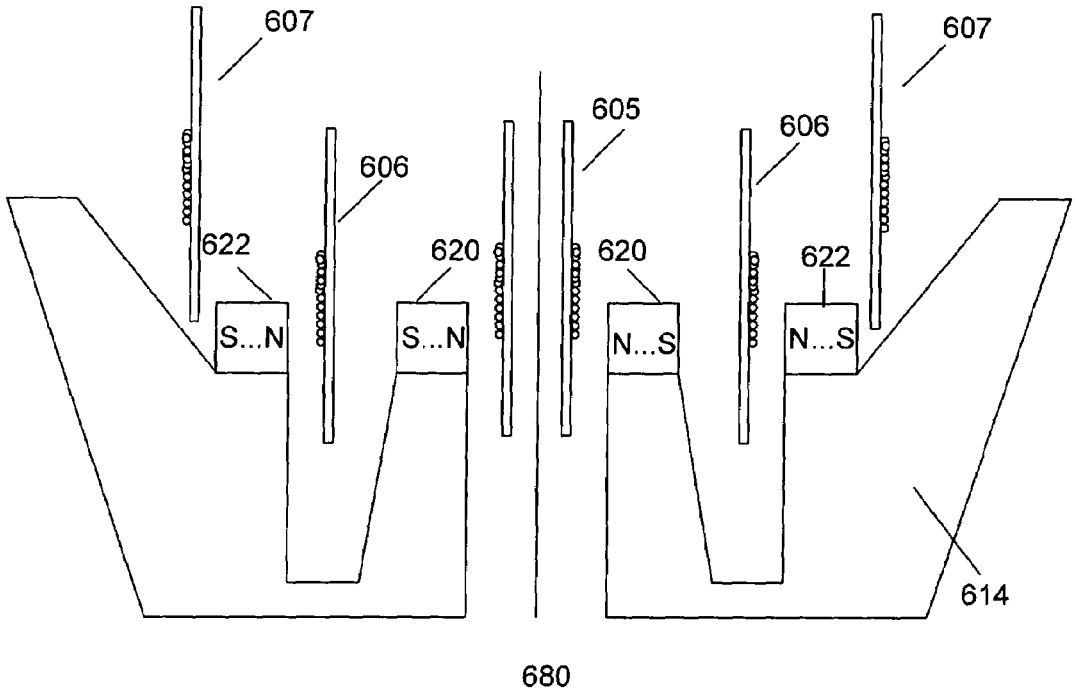
FIG. 6 is an audio loudspeaker with a triple voice-coil design.

Alternatively, multiple voice-coils may be used with the concentric magnet design. For example, the loudspeaker may comprise a double voice-coil transducer as depicted in FIG. 5, where there is one voice-coil 505 located within the inner diameter of the inner magnet 520 along the axis of symmetry of the inner magnet 520, and a second voice-coil 506 located in the gap between the inner and outer magnets (520 and 522), as described earlier. The system may also include a triple voice-coil transducer as depicted in FIG. 6, where there are two voice-coils (605 and 606) located as in the double voice-coil transducer depicted in FIG. 5, along with a third voice-coil 607 located outside the outer magnet 622, where the concentric magnet system is wholly contained within the diameter of the third voice-coil 607.

Figure 3:
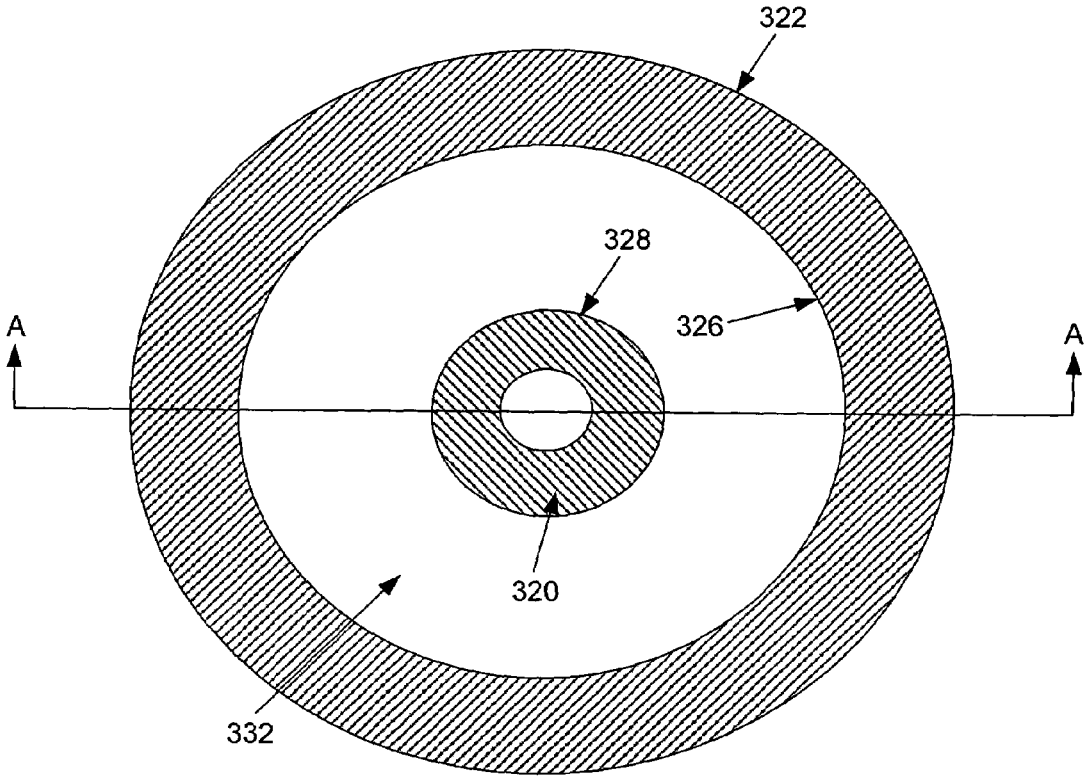
FIG. 3 is the view of FIG. 2 with a cut-line indicating a cross-sectional view.
Figure 4:
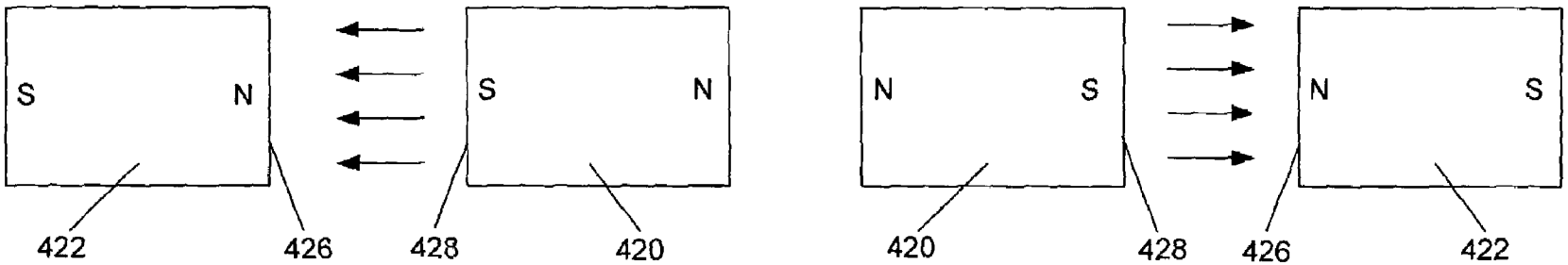
FIG. 4 is a cross-sectional view of FIG. 3 indicating the magnetic flux.

FIG. 4 depicts the cross-section of the inner and outer magnets (420 and 422) as represented by the cut-line A-A in FIG. 3. Inner magnet 420 and outer magnet 422 may be radially magnetized such that the interior edge 426 of outer magnet 422 and the interior edge 434 of inner magnet 420 may be of one polarity and the outer edges 428 and 436 are of the opposite polarity to the inner edges. In this way, when inner magnet 420 is positioned within central hole 424 of outer magnet 422, the polarity of the outer edge 428 of inner magnet 420 is of the opposite polarity of the inner edge 426 of the outer magnet 422 as shown in FIG. 4. The inner and outer magnets (420 and 422) may be made of neodymium, ferrite, or other common magnetic materials known in the art. The inner and outer magnets (420 and 422) may also be composed of permanent magnetic materials.

The magnetic flux between the inner and outer magnets (420 and 422) may be directed approximately radially through the outer magnet 422, radially through the air gap 432 to inner magnet 420. The magnetic flux may be constant in a region including the gap 432 and dropping to a low value outside the region including the gap 432.

Inner magnet 120 and outer magnet 122 may be held in place by the chassis 114. The chassis 114 also may act as a heat sink for the loudspeaker by allowing heat to flow from the outer magnet into the chassis. The chassis 114 may be formed of any suitable material. For example, the chassis may be formed of aluminum, steel, plastic, or composite.

Former 210, which may be attached to the diaphragm, may extend from the diaphragm into the gap 232. The former may be constructed of a thermally conductive material for conducting heat away from the voice-coil. Airflow through the gap 232 removes heat from the former 210 through convective heat transfer. The former 210 may be made of any suitable material such as aluminum or copper, as well as plastics, paper, or composite. Former 210 may be a cylindrical tube having tube walls from about 0.05 mm to about 5.00 mm thick. Voice-coil 206 may be wound around the former 210 and extends in the gap 232. Voice-coil 206 may be any suitable material, for example copper or aluminum wire and is attached to the former 210 through a conventional adhesive. Voice-coil 206 may be from about 3 mm to about 100 mm in length. The preferred number of times the voice-coil wire may be wound around the former depends upon the size of the loudspeaker.

Figure 7:
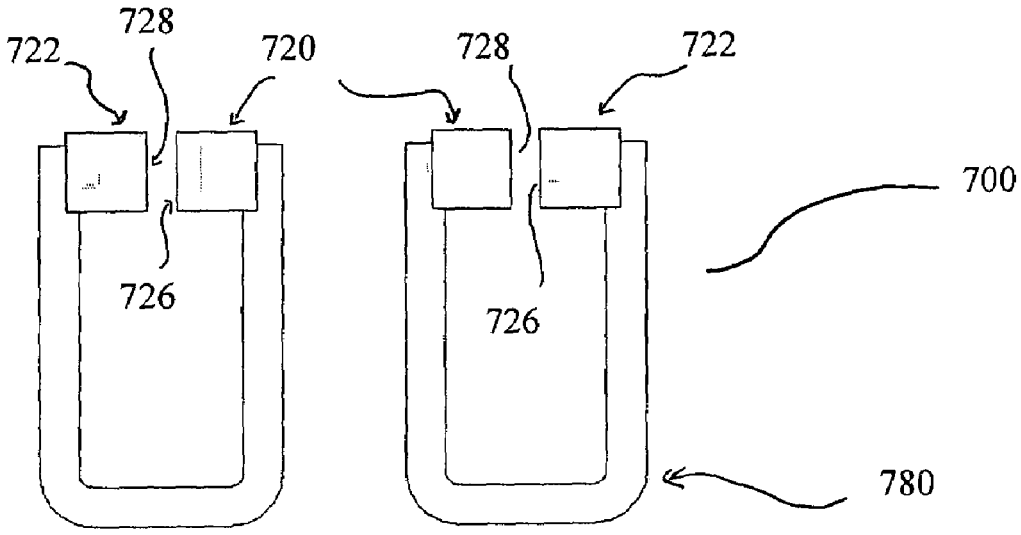
FIG. 7 is a dual radial magnet design with a ferrous return path.

FIG. 7 present a dual radial ring motor design with a ferrous return path 780. There are three main functions of ferrous material in a magnetic circuit. One function is to focus the field (make it stronger in a smaller area). Permanent magnets operate at higher field levels when there is a high permeability path between their north and south poles. Another function for a ferrous return path 780 is to provide that path. The force on a moving current is perpendicular to both the direction of the current flow and the direction of the magnetic field. The cylindrical geometry of the voice-coil 206 requires a radial field to provide axial force. It has been easier to make magnets with an axial orientation. Ferrous materials are used to adjust the field into an axial orientation.

In FIG. 7, a dual radial voice-coil transducer 700 including an inner magnet 720, an outer magnet 722, voice-coil 706, and a ferrous return path 780 are depicted. The ferrous return path 780 connects the first, inner magnet 720 to the second, outer magnet 722 in a region located exterior to the gap between the outer diameter 728 of the second, inner magnet 720 and the inner diameter 726 of the first, outer magnet 722. The ferrous return path 780 may be composed of a magnetic material, such as steel, or permanent magnetic materials. The dual radial ring design may also be incorporated into voice-coil transducers with multiple voice-coils, such as those depicted in FIGS. 5 and 6. For automotive applications, a ferrous return path 780 is needed in a dual radial design because of the required magnetic field strength.

The loudspeaker diaphragm of the invention may be incorporated into any loudspeaker, including sub woofers, bass, and midrange loudspeakers. The diaphragms may also be suitable for use in loudspeakers for automobile applications. In automotive applications, the weight of a loudspeaker is an important design parameter. By avoiding the use of a steel pole piece in the magnet design, the concentric magnet design may reduce motor weight up to 60%.

The concentric radial magnet design also may enhance the linearity of the system performance by providing a region where the voice-coil-field interaction is approximately constant with no variation over the region. The absence of a steel pole piece in the concentric magnet design also may reduce the impedance of the system, as there is no ferrous metal to affect the voice-coil inductance. Ideally, a loudspeaker reproduces sound in proportion to the voltage supplied to it regardless of voltage amplitude and frequency. However, the presence of ferrous materials in the voice-coil will change this response by increasing the inductance, and therefore impedance, of the system. The concentric magnet design of the application removes this source of impedance.

Figure 8:
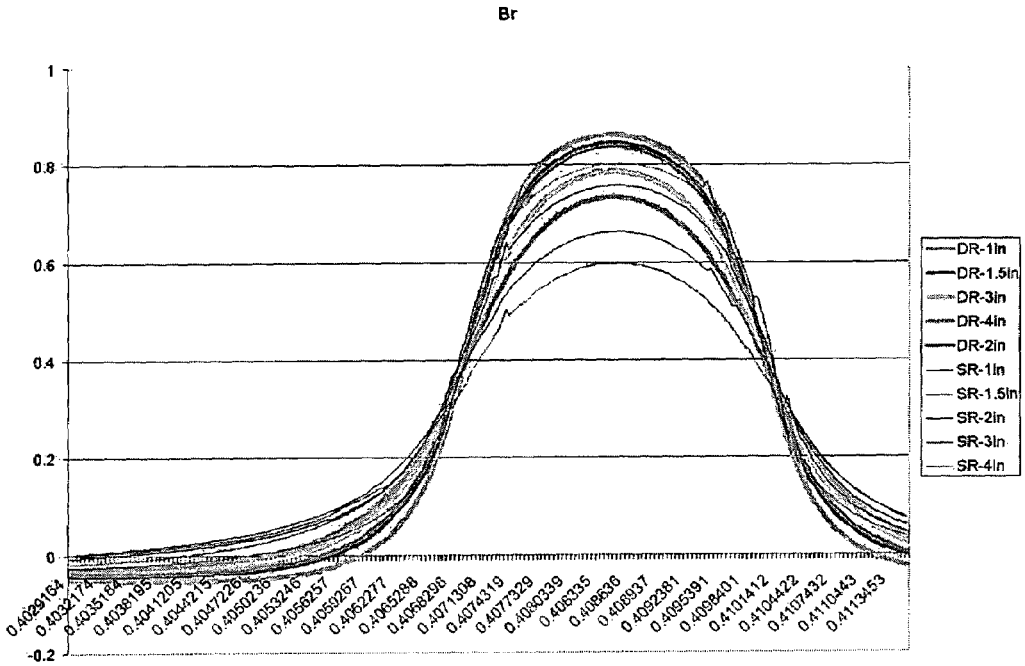
FIG. 8 is a chart comparing the performance of ring motor designs.

FIG. 8 presents a chart depicting the magnetic field strength performance of a dual radial ring motor design compared to a dual axial ring motor design. The dual radial design provides a higher magnetic field strength at the center of the gap (indicated by 0.04085 along the x-axis of the graph) compared to the dual axial ring motor design. The weight characteristics of the dual radial ring design are higher than that of the dual axial ring design, which may present some design considerations.

In addition, the concentric magnet design may allow the system to run cooler than a system with a ferrous pole piece, because the concentric magnet system may be placed closer to a heat sink for heat dissipation. In a standard, non-concentric magnet system with a steel pole piece, the heat produced by the voice-coil 106 is dissipated through the steel. By avoiding the need for a magnetic material pole piece, a non-magnetic material with higher heat conduction capability may be used in the chassis 114. For example, the frame may be composed of aluminum, which is five times more heat conductive than steel and lighter as well.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A voice-coil transducer comprising:

a first magnet having an annular shape with an inner diameter and an outer diameter;

a second magnet having an annular shape with an inner diameter and an outer diameter, where the second magnet is located within the inner diameter of the first magnet and is concentric with the first magnet;

a gap between the outer diameter of the second magnet and the inner diameter of the first magnet, where the first and second magnets are radially polarized;

at least one voice-coil comprising at least one former and at least one winding located on the former, where at least a portion of the voice-coil is located in the gap; and a diaphragm in communication with the former.

2. A voice-coil transducer as in claim 1, further comprising a ferrous return path, where the ferrous return path connects the first magnet to the second magnet in a region located exterior to the gap, and where the ferrous return path comprises a magnetic material.

3. A voice-coil transducer as in claim 2, where the ferrous return path comprises a permanent magnetic material.

4. A voice-coil transducer as in claim 1, where the gap is filled with a magnetic solution.

5. A voice-coil transducer as in claim 4, where the magnetic solution comprises a solution of oil and suspended magnetic particles.

6. A voice-coil transducer as in claim 1, where the gap is between 1 mm and 10 mm in width.

7. A voice-coil transducer as in claim 1, where the first and second magnets comprise neodymium or ferrite materials.

8. A voice-coil transducer as in claim 1, where the first and second magnets comprise permanent magnetic materials.

9. A voice-coil transducer as in claim 1, where the former comprises a material selected from the group consisting of: aluminum, plastic, paper, and composite.

10. An audio loudspeaker comprising:

a first magnet having an annular shape with an inner diameter and an outer diameter;

a second magnet having an annular shape with an inner diameter and an outer diameter, where the second magnet is located within the inner diameter of the first magnet and is concentric with the first magnet;

a gap between the outer diameter of the second magnet and the inner diameter of the first magnet, where the first and second magnets are radially polarized, creating magnetic flux in a region of the gap;

at least one voice-coil comprising at least one former and at least one winding located on the former, where at least a portion of the voice-coil is located in the gap;

a diaphragm in communication with the voice-coil; and a chassis, where the chassis supports the diaphragm, first and second magnets, and voice-coil.

11. An audio loudspeaker as in claim 10, further comprising a ferrous return path, where the ferrous return path connects the first magnet to the second magnet in a region located exterior to the gap, and where the ferrous return path comprises a magnetic material.

12. An audio loudspeaker as in claim 11, where the ferrous return path comprises a permanent magnetic material.

13. A voice-coil transducer as in claim 10, where the chassis comprises a material selected from the group consisting of: aluminum, steel, plastic, and composites.

14. An audio loudspeaker as in claim 10, where the outer diameter of the first magnet is between about 25 mm and about 450 mm.

15. An audio loudspeaker as in claim 11, where the audio loudspeaker is configured for use in an automobile.

16. A voice-coil transducer as in claim 2, where the voice-coil transducer has a first voice-coil located within the inner diameter of the second magnet and a second voice-coil located in the region of the gap.

17. A voice-coil transducer as in claim 16, where the voice-coil transducer further comprises a third voice-coil located outside the outer diameter of the first magnet and concentric to the first and second voice-coil.

18. An audio loudspeaker comprising the voice-coil transducer of claim 16.

19. An audio loudspeaker comprising the voice-coil transducer of claim 17.

20. An audio loudspeaker as in claim 10, where the voice-coil is between 3 mm and 100 mm in length.

21. An audio loudspeaker as in claim 18, where the audio loudspeaker is configured for operation in an automobile.

22. A voice-coil transducer as in claim 19 where the voice-coil transducer is configured for operation in an automobile.

23. A voice-coil transducer as in claim 2, where the voice-coil transducer is configured for operation in an automobile.

24. A voice-coil transducer comprising:

a first magnet having an annular shape with an inner diameter and an outer diameter;

a second magnet having an annular shape with an inner diameter and an outer diameter, where the second magnet is located within the inner diameter of the first magnet and is concentric with the first magnet, and where the first and second magnets are radially polarized, creating magnetic flux in a region of a gap between the outer diameter of the second magnet and the inner diameter of the first magnet;

at least one voice-coil comprising at least one former and at least one winding located on the former, where at least a portion of the voice-coil is located in the gap; and a diaphragm in communication with the former.

25. A voice-coil transducer as in claim 24, further comprising a ferrous return path, where the ferrous return path connects the first magnet to the second magnet in a region located exterior to the gap, and where the ferrous return path comprises a magnetic material.

26. A voice-coil transducer as in claim 25, where the ferrous return path comprises a permanent magnetic material.

27. An audio loudspeaker comprising the voice-coil transducer of claim 24.

28. A voice-coil transducer as in claim 24 where the voice-coil transducer is configured for operation in an automobile.

29. An audio loudspeaker as in claim 27, where the audio loudspeaker is configured for operation in an automobile.

30. A voice-coil transducer as in claim 10, where the magnetic flux is constant in the region of the gap.

31. The audio loudspeaker of claim 10, where the chassis is formed to receive at least a portion of the former.

* * * * *